US011011136B2

(12) United States Patent
Takiguchi

(10) Patent No.: US 11,011,136 B2
(45) Date of Patent: May 18, 2021

(54) IMAGE DATA PROCESSING DEVICE AND DISPLAY DEVICE INCLUDING THE SAME

(71) Applicant: Samsung Display Co., Ltd., Yongin-si (KR)

(72) Inventor: Masahiko Takiguchi, Yokohama (JP)

(73) Assignee: Samsung Display Co., Ltd., Yongin-si (KR)

( * ) Notice: Subject to any disclaimer, the term of this patent is extended or adjusted under 35 U.S.C. 154(b) by 42 days.

(21) Appl. No.: 16/529,610

(22) Filed: Aug. 1, 2019

(65) Prior Publication Data

US 2020/0135143 A1 Apr. 30, 2020

(30) Foreign Application Priority Data

Oct. 29, 2018 (KR) ..... 10-2018-0130004

(51) Int. Cl.

| | |
|---|---|
| ***G09G 3/3225*** | (2016.01) |
| ***G09G 5/10*** | (2006.01) |
| ***G09G 3/3208*** | (2016.01) |
| ***G09G 5/18*** | (2006.01) |
| ***G09G 3/20*** | (2006.01) |
| ***G09G 5/02*** | (2006.01) |

(52) U.S. Cl.

CPC ..... *G09G 5/10* (2013.01); *G09G 3/2018* (2013.01); *G09G 3/3208* (2013.01); *G09G 5/02* (2013.01); *G09G 5/18* (2013.01); *G09G 2310/0267* (2013.01)

(58) Field of Classification Search

CPC ..... G09G 5/10; G09G 3/3208; G09G 5/18; G09G 3/2018; G09G 5/02; G09G 2310/0267; G09G 3/3225; G09G 3/2003; G09G 2340/06; G09G 2320/046; G09G 2360/16; G09G 2300/0452; G09G 2320/045; G09G 3/3291; G09G 3/3258

See application file for complete search history.

(56) References Cited

U.S. PATENT DOCUMENTS

| | | | |
|---|---|---|---|
| 7,808,462 B2 | 10/2010 | Tanase et al. | |
| 8,436,875 B2 | 5/2013 | Ueki et al. | |
| 9,430,964 B2 | 8/2016 | Jeong et al. | |
| 2013/0176498 A1* | 7/2013 | Noutoshi | H04N 9/67 348/712 |

(Continued)

FOREIGN PATENT DOCUMENTS

| | | |
|---|---|---|
| EP | 2 357 641 A1 | 8/2011 |
| JP | 2006-267148 A | 10/2006 |

(Continued)

*Primary Examiner* — Amit Chatly

(74) *Attorney, Agent, or Firm* — Lewis Roca Rothgerber Christie LLP

(57) ABSTRACT

An image data processing device of the inventive concept includes an image data converter and a light emission amount calculator. The image data converter converts image data into modulation image data. The image data includes first to third data corresponding to the first to third colors, respectively. The modulation image data includes first to fourth modulation data corresponding to the first to fourth colors, respectively. The light emission amount calculator calculates the fourth modulation data based on the ratio between the first data and the second data. The fourth color includes a color based on mixing the first color and the second color.

20 Claims, 8 Drawing Sheets

(56) References Cited

U.S. PATENT DOCUMENTS

| | | | | |
|---|---|---|---|---|
| 2015/0235615 | A1* | 8/2015 | Yoshida | G09G 5/028 345/600 |
| 2018/0176525 | A1* | 6/2018 | Wu | H04N 9/646 |
| 2019/0080645 | A1* | 3/2019 | Chaji | H01L 33/502 |

FOREIGN PATENT DOCUMENTS

| | | | |
|---|---|---|---|
| JP | 2009-217515 | A | 9/2009 |
| JP | 5313066 | B2 | 10/2013 |
| KR | 2011-0084310 | A | 7/2011 |
| KR | 2014-0078502 | A | 6/2014 |

* cited by examiner

IMAGE DATA PROCESSING DEVICE AND DISPLAY DEVICE INCLUDING THE SAME

CROSS-REFERENCE TO RELATED APPLICATION

This application claims priority to and the benefit of Korean Patent Application No. 10-2018-0130004, filed on Oct. 29, 2018, the entire contents of which are hereby incorporated by reference.

BACKGROUND

An aspect of the present invention relates to an image data processing device and a display device including the same, and more particularly to, an image data processing device for image processing corresponding to four or more color pixels and a display device including the same.

An organic light emitting display displays an image using an organic light emitting diode that generates light by recombination of electrons and holes. Such an organic light emitting display device has a fast response speed, is driven with low power consumption, and has advantages of excellent luminous efficiency, luminance, and viewing angle.

When an organic light emitting display is driven for a long time, the transistor or the organic light emitting diode inside a pixel may deteriorate. In addition, when the same image is continuously displayed in a part of the display area of the organic light emitting display device, a different degree of deterioration may occur between the corresponding display area and an adjacent display area. Such a difference in the degree of deterioration may cause display quality degradation (e.g., an afterimage).

SUMMARY

Aspects of some example embodiments are directed toward an image data processing device for improving display characteristics and reducing an afterimage due to deterioration and a display device including the same.

An embodiment of the inventive concept provides an image data processing device including an image data converter and a light emission amount calculator. The image data converter converts image data into modulation image data. The image data includes first to third data corresponding to the first to third colors, respectively. The modulation image data includes first to fourth modulation data corresponding to the first to fourth colors, respectively. The light emission amount calculator calculates the fourth modulation data based on a ratio between the first data and the second data. The first to third colors are different from each other, and the fourth color includes a color based on mixing the first color and the second color.

The light emission amount calculator may determine a lowest value from among the first data and the second data as a component amount corresponding to the upper limit of the fourth modulation data. If the ratio is less than the reference ratio, the light emission amount calculator may determine the amount of the component as the value of the fourth modulation data. If the ratio is greater than the reference ratio, the light emission amount calculator may determine a value smaller than the component amount as the value of the fourth modulation data. The value of the fourth modulation data may decrease as the ratio increases.

The light emission amount calculator may calculate a utilization rate corresponding to the fourth color based on the ratio and calculate the fourth modulation data based on the utilization rate. The light emission amount calculator may determine the fourth modulation data by multiplying the component amount corresponding to the upper limit of the fourth modulation data by the utilization rate.

The image data converter may determine values of the first to third modulation data based on the value of the fourth modulation data calculated from the light emission amount calculator. The image data converter converts the image data into three-dimensional coordinate values on the basis of an XYZ color space, and applies the three-dimensional coordinate values and a value of the fourth modulation data to a transform matrix, to generate the first to fourth modulation data. The first to fourth modulation data are generated by multiplying an inverse matrix of the transform matrix by a column vector including the three-dimensional coordinate values and a value of the fourth modulation data.

The modulation image data may further include fifth modulation data corresponding to a fifth color based on mixing the second color and the third color. In this case, the light emission amount calculator may further calculate the fifth modulation data based on a ratio between the second data and the third data.

The light emission amount calculator may calculate a first component amount corresponding to an upper limit of the fourth modulation data by subtracting a first overlapped component amount from a lowest value from among the first data and the second data, and calculate a second component amount corresponding to an upper limit of the fifth modulation data by subtracting a second overlapped component amount from a lowest value from among the second data and the third data. The first overlapped component amount has a value obtained by multiplying a ratio of the third data to a sum of the first data and the third data by a lowest value from among the first to third data, and the second overlapped component amount has a value obtained by multiplying a ratio of the first data to a sum of the first data and the third data by the lowest value from among the first to third data.

In an embodiment of the inventive concept, a display device includes a display panel and a driving circuit. The display panel includes first to fourth pixels corresponding to the first to fourth colors, respectively. The driving circuit generates first to fourth data voltages provided to the first to fourth pixels, respectively, based on image data including first to third data corresponding to the first to third colors, respectively. The driving circuit includes an image data processing device configured to generate first to fourth modulation data corresponding to the first to fourth pixels, respectively, based on a ratio between the first data and the second data, and a data driver configured to generate the first to fourth data voltages based on the first to fourth modulation data.

The image data processing device includes a light emission amount calculator and an image data converter. The light emission amount calculator calculates a utilization rate of the fourth pixel based on the ratio and calculates a value of the fourth modulation data based on the utilization rate The image data converter generates the first to fourth modulation data by adjusting values of the first to third data based on the value of the fourth modulation data.

The image data processing device may further include a preprocessor configured to adjust the image data to correspond to the first to fourth pixels based on image data accumulated before the image data.

The image data processing device may further include a deterioration information calculator configured to calculate deterioration information of each of the first to fourth pixels based on the first to fourth modulation data, and a transform function of the utilization rate for the ratio may be adjusted based on the deterioration information.

The first pixel may be a red color pixel, the second pixel may be a green color pixel, the third pixel may be a blue color pixel, and the fourth pixel may be a yellow color pixel.

The display panel may further include a fifth pixel corresponding to a fifth color based on mixing the second color and the third color. The image data processing device may be further configured to generate fifth modulation data corresponding to the fifth pixel based on a ratio between the second data and the third data. The data driver may be further configured to generate a fifth data voltage based on the fifth modulation data.

When a value of the first data is greater than a value of the third data, a value of the fourth modulation data may be greater than a value of the fifth modulation data. When the value of the third data is greater than the value of the first data, the value of the fifth modulation data may be greater than the value of the fourth modulation data.

The first pixel may be a red color pixel, the second pixel may be a green color pixel, the third pixel may be a blue color pixel, the fourth pixel may be a yellow color pixel, and the fifth pixel may be a cyan color pixel.

BRIEF DESCRIPTION OF THE DRAWINGS

The accompanying drawings are included to provide a further understanding of the inventive concept. The drawings illustrate exemplary embodiments of the inventive concept and, together with the description, serve to explain principles of the inventive concept.

DETAILED DESCRIPTION

Figure 1:
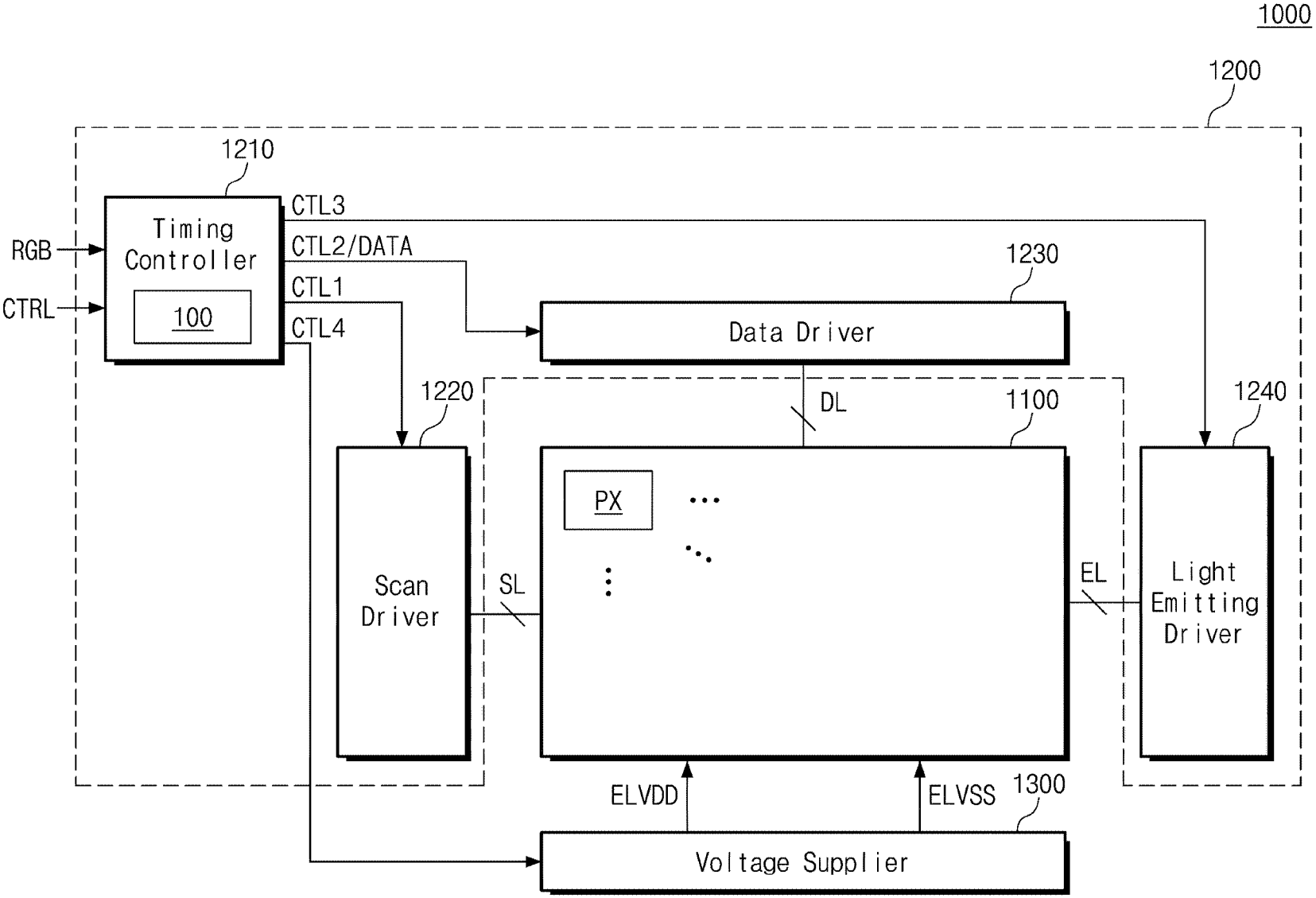
FIG. 1 is an exemplary block diagram of a display device according to an embodiment of the inventive concept.

Various modifications are possible in various embodiments of the inventive concept, specific embodiments are illustrated in drawings, and related detailed descriptions are listed below. However, this does not limit various embodiments of the inventive concept to a specific embodiment and it should be understood that the inventive concept covers all the modifications, equivalents, and/or replacements of this disclosure provided they come within the scope of the appended claims and their equivalents.

Like reference numerals refer to like elements throughout the drawings. It will be understood that the terms "first," "second," "third," etc., are used herein to describe various components but these components should not be limited by these terms. The above terms are used only to distinguish one component from another. For example, a first component may be referred to as a second component and vice versa without departing from the scope of the inventive concept. The singular expressions include plural expressions unless the context clearly dictates otherwise.

Additionally, in various embodiments of the inventive concept, the term "include," "comprise," "including," or "comprising," specifies a property, a region, a fixed number, a step, a process, an element and/or a component but does not exclude other properties, regions, fixed numbers, steps, processes, elements and/or components. The terminology used herein is for the purpose of describing particular embodiments only and is not intended to be limiting of the inventive concept. As used herein, the singular forms "a", "an" and "the" are intended to include the plural forms as well, unless the context clearly indicates otherwise. As used herein, the term "and/or" includes any and all combinations of one or more of the associated listed items. Further, the use of "may" when describing embodiments of the inventive concept refers to "one or more embodiments of the inventive concept." Also, the term "exemplary" is intended to refer to an example or illustration.

It will be understood that when an element or layer is referred to as being "connected to"or "adjacent to" another element or layer, it can be connected to or adjacent to the other element or layer, or one or more intervening elements or layers may be present. In contrast, when an element or layer is referred to as being "directly connected to" or "immediately adjacent to" another element or layer, there are no intervening elements or layers present.

As used herein, the term "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

The electronic or electric devices and/or any other relevant devices or components according to embodiments of the present disclosure described herein, such as, for example, a timing controller, a data driver, and a gate driver, may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of ordinary skill in the art should recognize that the functionality of various computing/electronic devices may be combined or integrated into a single computing/electronic device, or the functionality of a particular computing/electronic device may be distributed across one or more other computing/electronic devices without departing from the spirit and scope of the present disclosure.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is an exemplary block diagram of a display device according to an embodiment of the inventive concept. Referring to FIG. 1, a display device 1000 may include a display panel 1100, a driving circuit 1200, and a voltage supplier 1300.

The display panel 1100 may be an organic light emitting display panel. The display panel 1100 may include a plurality of data lines DL, a plurality of scan lines SL, a plurality of light emission control lines EL, and a plurality of unit pixels PX.

Although not specifically shown in the drawing, the plurality of data lines DL and the plurality of scan lines SL intersect or cross each other. The plurality of scan lines SL and the plurality of light emission control lines EL may be arranged side by side. The plurality of data lines DL, the plurality of scan lines SL, and the plurality of light emission control lines EL may define pixel areas, and the plurality of unit pixels PX for displaying an image in pixel areas may be provided. The plurality of data lines DL, the plurality of scan lines SL, and the plurality of light emission control lines EL may be insulated from each other.

Each of the plurality of unit pixels PX may be connected to at least one data line, at least one scan line, and at least one light emission control line. The unit pixel PX may include a plurality of sub-pixels. Each of the sub-pixels may display one of the primary colors or one of the mixed colors. The primary colors may include red, green, or blue, and the mixed colors may include various colors such as white, yellow, cyan, magenta, and the like. However, the color displayed by the sub-pixel is not limited thereto.

The driving circuit 1200 may include a timing controller 1210, a scan driver 1220, a data driver 1230, and a light emitting driver 1240. The timing controller 1210, the scan driver 1220, the data driver 1230, and the light emitting driver 1240 may be connected to the display panel 1100 in the form of a chip on flexible printed circuit (COF), a chip on glass (COG), and/or a flexible printed circuit (FPC).

The timing controller 1210 may receive image data RGB and a control signal CTRL from the outside. The timing controller 1210 may generate first to fourth driving control signals CTL1 to CTL4 and may generate an image data signal DATA. The first driving control signal CTL1 may be a signal for controlling the scan driver 1220. The second driving control signal CTL2 may be a signal for controlling the data driver 1230. The third driving control signal CTL3 may be a signal for controlling the light emitting driver 1240. The fourth driving control signal CTL4 may be a signal for controlling the voltage supplier 1300. The image data signal DATA may be a signal obtained by modulating image data RGB in correspondence to the display type of the display panel 1100.

The timing controller 1210 may include an image data processing device 100. The image data processing device 100 may convert the image data RGB into modulation image data. For example, the unit pixel PX may include four or more sub-pixels and the image data RGB may include color data corresponding to three kinds of colors (e.g., red, green, and blue). In this case, at least one sub-pixel may represent a mixed color. The image data processing device 100 may determine the data corresponding to the mixed color by distributing the data corresponding to the primary color. The details of the image data processing device 100 will be described later.

The scan driver 1220 may provide a scan signal to each of the plurality of unit pixels PX through the plurality of scan lines SL based on the first driving control signal CTL1. Based on the scan signal, the image may be displayed on the display panel 1100.

The data driver 1230 may provide the data voltage to each of the plurality of unit pixels PX through the plurality of data lines DL based on the second driving control signal CTL2. The data driver 1230 may convert the image data signal DATA to a data voltage. Based on the data voltage, the image displayed on the display panel 1100 may be determined.

The light emitting driver 1240 may provide a light emission control signal to each of the plurality of unit pixels PX through the plurality of light emission control lines EL based on the third driving control signal CTL3. Based on the light emission control signal, the luminance of the display panel 1100 may be set or adjusted.

The voltage supplier 1300 may provide the first power supply voltage ELVDD and the second power supply voltage ELVSS to the display panel 1100 based on the fourth driving control signal CTL4. Based on the first power supply voltage ELVDD and the second power supply voltage ELVSS, the display panel 1100 may be driven.

Figure 2:
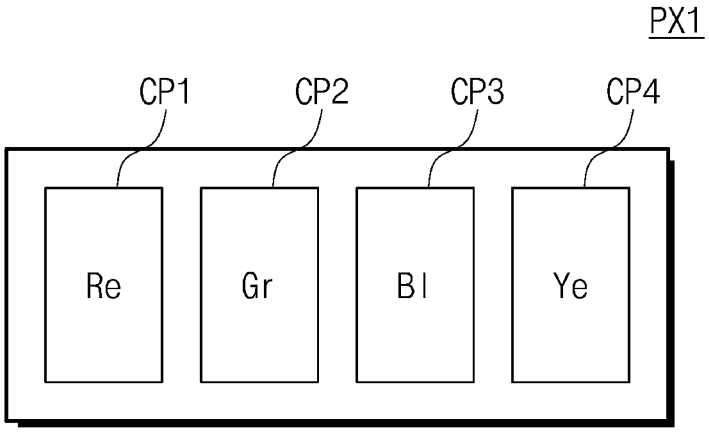
FIG. 2 is an exemplary view of a unit pixel according to an embodiment of the inventive concept.

FIG. 2 is an exemplary view of a unit pixel according to an embodiment of the inventive concept. Referring to FIG. 2, the unit pixel PX1 may include first to fourth sub-pixels CP1 to CP4. In some embodiments, the first sub-pixel CP1 may be a red color pixel, the second sub-pixel CP2 may be a green color pixel, the third sub-pixel CP3 may be a blue color pixel, and the fourth sub-pixel CP4 may be a yellow color pixel.

The first to fourth sub-pixels CP1 to CP4 of FIG. 2 may be arranged in the lateral direction, but the arrangement order is not limited thereto. The first to fourth sub-pixels CP1 to CP4 may be connected to one scan line or one light emission line, but not limited thereto. Some of the first to fourth sub-pixels CP1 to CP4 may be connected to the first scan line or the first light emission line, and the remaining may be connected to the second scan line or the second light emission line. In some embodiments, the first to fourth sub-pixels CP1 to CP4 may be arranged in the longitudinal direction. In some embodiments, the first to fourth sub-pixels CP1 to CP4 may share one or more data lines. In some embodiments, two of the first to fourth sub-pixels CP1 to CP4 may be arranged in the first row, and the remaining two sub-pixels may be arranged in the second row.

Hereinafter, for convenience of description, the technical idea of the inventive concept described with reference to FIGS. 3-9 is described assuming that the unit pixel PX1 includes three color pixels representing the primary colors and one color pixel representing the mixed color. And, for convenience of explanation, it is assumed that the mixed color is yellow. Yellow is a mixed color of red and green. It will be understood that the mixed colors described below may be applied to various mixed colors such as magenta, which is a mixed color of red and blue, or cyan, which is a mixed color of green and blue.

Figure 3:
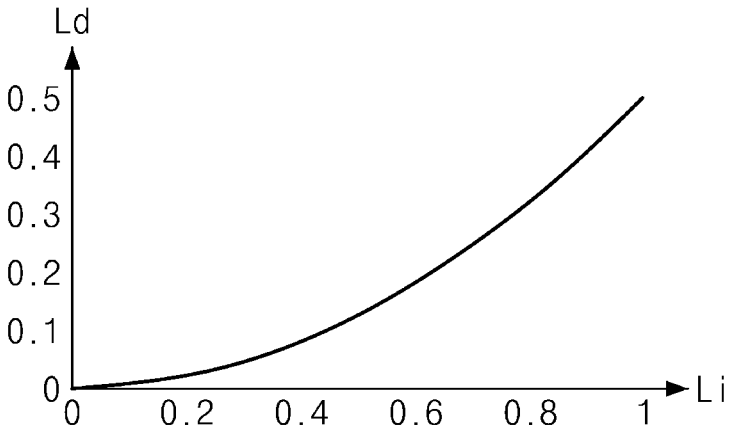
FIG. 3 is a graph for explaining the degree of deterioration according to use of the pixel in an embodiment of the present inventive concept.

FIG. 3 is a graph for explaining the degree of deterioration according to use of the pixel in an embodiment of the present inventive concept. Referring to FIG. 3, the horizontal axis is defined as an initial luminance ratio Li, and the vertical axis is defined as a luminance reduction amount Ld. The initial luminance ratio Li is defined as the relative ratio of the initial luminance of the target pixel with respect to the reference luminance. Illustratively, the reference luminance is assumed to be the initial luminance when the value of the image data corresponding to the target pixel is 1. The initial luminance is defined as the luminance for the image data corresponding to the target pixel before degradation proceeds.

$$Ld(1-Lr)\times Li^2 \quad \text{Equation 1}$$

$$Lr=e^{-(Tn/a)^b} \quad \text{Equation 2}$$

Referring to Equation 1, Lr is defined as a luminance reduction rate. Referring to Equation 2, Tn is defined as a relative value of the light emission time when assuming that the half-life of the pixel lifetime is 1, and a and b are constants according to the characteristics of the display device. When assuming that the luminance reduction rate Lr is fixed, the luminance reduction amount Ld may be represented as a quadratic function with respect to the initial luminance ratio Li as shown in the graph of FIG. 3. That is, as the initial luminance ratio Li decreases, the luminance reduction amount Ld decreases.

For example, if the first sub-pixel CP1 continues to emit light at the initial luminance ratio of 1, the luminance reduction amount Ld of the first sub-pixel CP1 is about 0.5. If the second sub-pixel CP2 adjacent to the first sub-pixel CP1 continues to emit light at an initial luminance ratio of 0.8, the luminance reduction amount Ld of the second sub-pixel CP2 is about 0.32. The difference in the luminance reduction amount between the first and second sub-pixels CP1 and CP2 may be about 0.18.

A pattern such as an icon or an information bar of a computer screen, or a logo of a TV broadcast may be continuously displayed in the same display area for a long period of time. In this case, deterioration may occur in the organic light emitting diodes included in the pixels of the corresponding display area. As a result, as previously calculated for the first and second sub-pixels CP1 and CP2, a difference in the luminance reduction amount Ld may be generated between adjacent pixels. Due to this difference in the luminance reduction amount Ld, even if the corresponding pattern is not displayed in the display area, the pattern shape may appear as afterimage.

Figure 4:
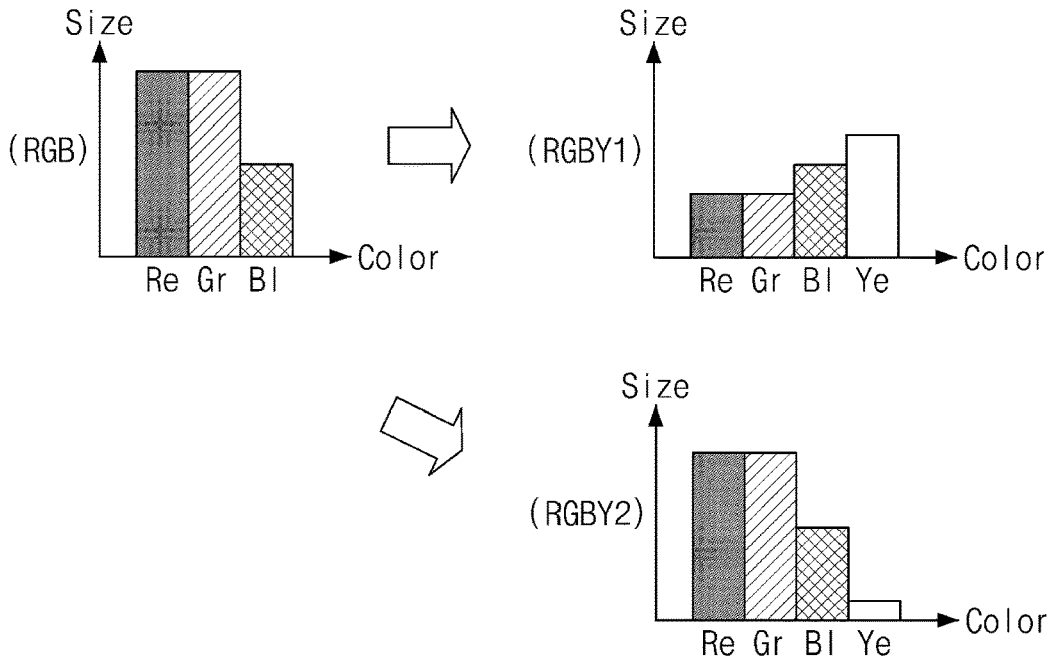
FIG. 4 is a graph for explaining an operation of modulating image data to correspond to sub-pixels according to an embodiment of the present inventive concept.

FIG. 4 is a graph for explaining an operation of modulating image data to correspond to sub-pixels according to an embodiment of the present inventive concept.

Referring to FIG. 4, the horizontal axis is defined as the type (e.g., color) of sub-pixel, and the vertical axis is defined as the size of the image data value corresponding to the sub-pixels. The image data RGB provided from the outside to the display device 1000 may include first data corresponding to red Re, second data corresponding to green Gr, and third data corresponding to blue BI.

It is assumed that the first data has a value of 1, the second data has a value of 1, and the third data has a value of 0.5 in the image data RGB. As shown in FIG. 2, when the unit pixel PX1 includes the fourth sub-pixel CP4 which is a yellow color pixel, the value of the fourth data corresponding to the fourth sub-pixel CP4 may be generated so that the values of the first and second data may be reduced. Illustratively, it is assumed that yellow Ye corresponding to the fourth sub-pixel CP4 is a color based on a 1:1 mixture of red and green. Illustratively, it is assumed that the luminance and chrominance of the image displayed when the first and second data values are 1 are equal to the luminance and chrominance of the image displayed when the fourth data value is 1.

The image data processing device 100 of FIG. 1 may convert image data RGB to modulation image data RGBY1 and RGBY2. The modulation image data RGBY1 and RGBY2 may include first modulation data corresponding to red Re, second modulation data corresponding to green Gr, third modulation data corresponding to blue BI, and fourth modulation data corresponding to yellow Ye.

In the first modulation image data RGBY1, the first modulation data may have a value of 0.33, the second modulation data may have a value of 0.33, the third modulation data may have a value of 0.5, and the fourth modulation data may have a value of 0.67. The image displayed from the first to third sub-pixels CP1 to CP3 by image data RGB may be the same as the image displayed from the first to fourth sub-pixels CP1 to CP4 by the first modulation image data RGBY1. Referring to the graph of FIG. 3, the initial luminance ratio Li of the first and second sub-pixels CP1 and CP2 may be 0.33 and the luminance reduction amount Ld may be about 0.05. The initial luminance ratio Li of the fourth sub-pixel CP4 may be 0.67 and the luminance reduction amount Ld may be about 0.22. Therefore, the difference in the luminance reduction amount Ld between the first and second sub-pixels CP1 and CP2 and the fourth sub-pixel CP4 may be about 0.17.

In the second modulation image data RGBY2, the first modulation data may have a value of 0.9, the second modulation data may have a value of 0.9, the third modulation data may have a value of 0.5, and the fourth modulation data may have a value of 0.1. The image displayed from the first to third sub-pixels CP1 to CP3 by image data RGB may be the same as the image displayed from the first to fourth sub-pixels CP1 to CP4 by the second modulation image data RGBY2. Referring to the graph of FIG. 3, the initial luminance ratio Li of the first and second sub-pixels CP1 and CP2 may be about 0.9 and the luminance reduction amount Ld may be about 0.405. The initial luminance ratio Li of the fourth sub-pixel CP4 may be 0.1 and the luminance reduction amount Ld may be about 0.005. Therefore, the difference in the luminance reduction amount Ld between the first and second sub-pixels CP1 and CP2 and the fourth sub-pixel CP4 may be about 0.4.

In addition to the first and second modulation image data RGBY1 and RGBY2, the number of modulation image data that may display the same image as image by the image data RGB is infinite.

$$\begin{bmatrix} X_{in} \\ Y_{in} \\ Z_{in} \end{bmatrix} = \begin{bmatrix} X_R & X_G & X_B & X_A \\ Y_R & Y_G & Y_B & Y_A \\ Z_R & Z_G & Z_B & Z_A \end{bmatrix} \begin{bmatrix} R \\ G \\ B \\ A \end{bmatrix} \quad \text{Equation 3}$$

Referring to Equation 3 and in some embodiments, $X_{in}$, $Y_{in}$, and $Z_{in}$ are defined by three-dimensional coordinate values obtained by converting image data RGB based on the XYZ color spaces. Each of R, G, B, and A values may be defined as a value of first to fourth modulation data. The transform matrix includes components $X_R, X_G, \ldots, Z_B, Z_A$ for the modulation image data to be transformed into three-dimensional coordinate values by the XYZ color space. Since the number of modulation data may be 4 but the number of equations derived from Equation 2 may be 3, the number of modulation image data may be plural. That is, according to the modulation scheme, the difference in the luminance reduction amount Ld between the sub-pixels may be set or adjusted. Below, in order to reduce the difference in the luminance reduction amount Ld and reduce the afterimage, the configuration and procedure for selecting a combination of modulation data is described.

Figure 5:
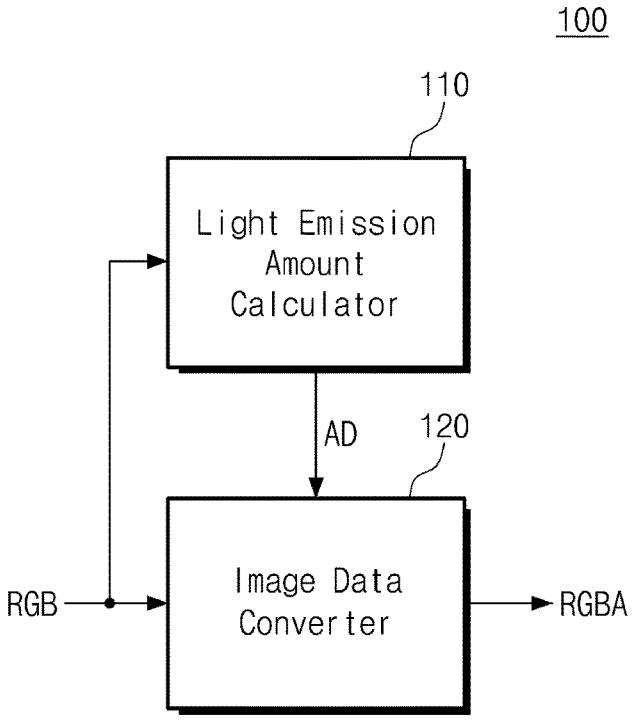
FIG. 5 is an exemplary block diagram of an image data processing device according to an embodiment of the inventive concept.

FIG. 5 is an exemplary block diagram of an image data processing device according to an embodiment of the inventive concept. Referring to FIG. 5, the image data processing device 100 may include a light emission amount calculator 110 and an image data converter 120. The light emission amount calculator 110 and image data converter 120 may be provided as an integrated circuit (IC), and may be implemented by a dedicated logic circuit such as a Field Programmable Gate Array (FPGA) or an Application Specific Integrated Circuit (ASIC). For convenience of explanation, referring to the reference numerals of FIG. 2, FIG. 5 will be described.

The light emission amount calculator 110 may calculate the value of the data corresponding to the fourth sub-pixel CP4 based on the image data RGB. The image data RGB may include first data corresponding to red, second data corresponding to green, and third data corresponding to blue. The light emission amount calculator 110 may calculate the value of the data corresponding to the fourth sub-pixel CP4 (hereinafter, the fourth data AD) based on the ratio between the first data and the second data.

The light emission amount calculator 110 may determine a small value (e.g., lowest value) from among the first data and the second data as a component amount corresponding to yellow. The component amount may be the upper limit of the value of the fourth data AD. The light emission amount calculator 110 may determine a ratio of a small value (e.g., lowest value) to a large value (e.g., highest value) among the first data and the second data as a component ratio corresponding to yellow. The light emission amount calculator 110 may calculate the utilization rate corresponding to the fourth sub-pixel CP4 based on the size of the component ratio. The light emission amount calculator 110 may convert the component ratio to a utilization rate through a look-up table, a transform function, or a transform matrix. The light emission amount calculator 110 may determine the value of the fourth data AD by multiplying the component ratio by the utilization rate.

The image data converter 120 may generate modulation image data RGBA based on the value of the fourth data AD determined from the light emission amount calculator 110. The modulation image data RGBA may include first modulation data corresponding to red, second modulation data corresponding to green, third modulation data corresponding to blue, and fourth modulation data corresponding to yellow. The image data converter 120 may generate the first to third modulation data by adjusting the values of the first to third data based on the fourth data AD. The fourth modulation data may be the same as the fourth data AD.

The image data converter 120 may generate one column vector by combining the first to third data included in the image data RGB and the fourth data AD determined from the light emission amount calculator 110. In this case, since the number of components of the column vector is equal to four as the number of required modulation data, one modulation image data RGBA may be determined.

Figure 6:
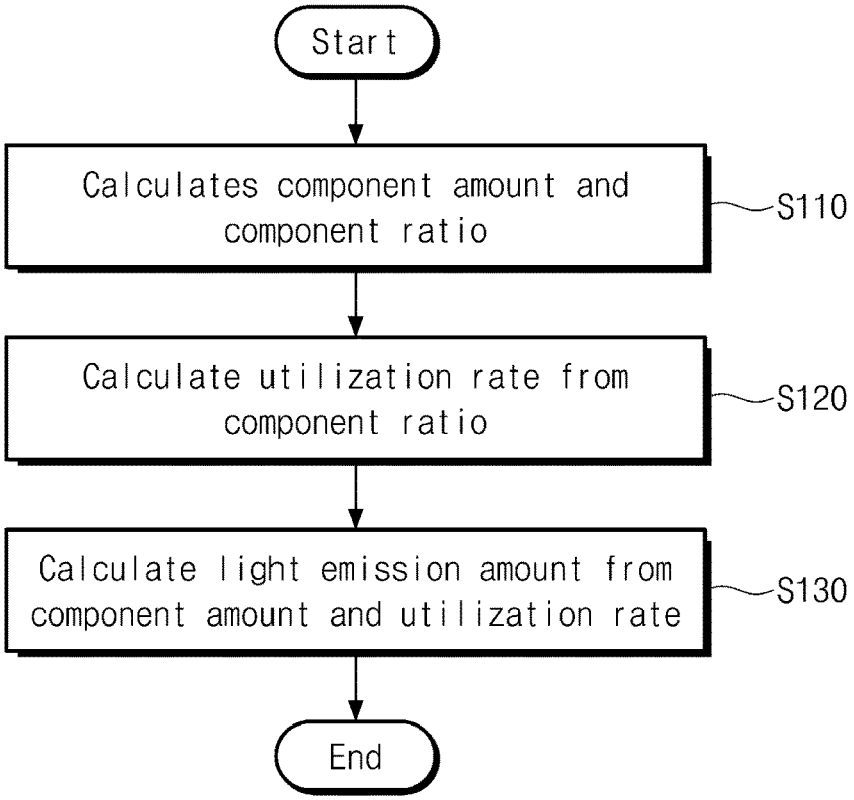
FIG. 6 is an exemplary flowchart of an image processing method of an image data processing device according to an embodiment of the inventive concept.

FIG. 6 is an exemplary flowchart of an image processing method of an image data processing device according to an embodiment of the inventive concept. Each operation of FIG. 6 is performed in the image data processing device 100 described with reference to FIG. 5. For convenience of description, with reference to the reference numerals of FIGS. 2-5, FIG. 6 will be described.

In operation S110, the image data processing device 100 calculates a component amount and a component ratio corresponding to the fourth sub-pixel CP4. Operation S110 may be performed in the light emission amount calculator 110. The component amount may be determined by a smaller value from among the first data corresponding to red and the second data corresponding to green. The component ratio may be a ratio of a small value (e.g., lowest value) to a large value (e.g., highest value) of the first data and the second data.

In operation S120, the image data processing device 100 may calculate a utilization rate corresponding to the fourth sub-pixel CP4 from the component ratio. Operation S120 may be performed in the light emission amount calculator 110. The utilization rate may be calculated so as to reduce or minimize the difference in the initial luminance ratio Li of each of the first sub-pixel CP1, the second sub-pixel CP2, and the fourth sub-pixel CP4, but is not limited thereto. The details of calculating the utilization rate from the component ratio will be described later.

In operation S130, the image data processing device 100 calculates the light emission amount from the component amount and the utilization rate. The light emission amount may correspond to the values of the modulation data corresponding to the first to fourth sub-pixels CP1 to CP4, respectively. The light emission amount calculator 110 may calculate the light emission amount, that is, the value of the fourth data AD, corresponding to the fourth sub-pixel CP4. The value of the fourth data AD may be a product of the component amount and the utilization rate. Also, the image data converter 120 may calculate the values of the first to fourth modulation data, that is, a light emission amount corresponding to each of the first to fourth sub-pixels CP1 to CP4, based on the value of the fourth data AD. The details of calculating the sub-pixel specific light emission amount will be described later.

Figure 7:
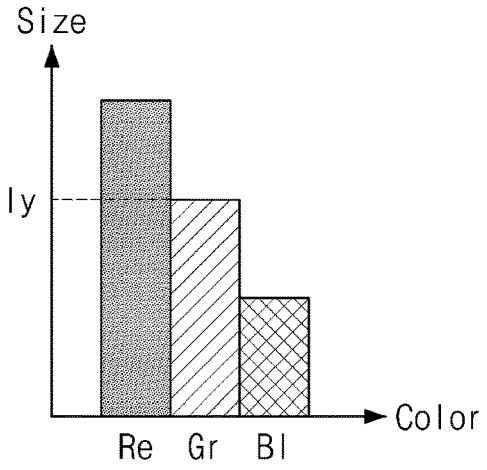
FIG. 7 is a graph for explaining an operation of calculating a component amount and a component ratio according to an embodiment of the present inventive concept.

FIG. 7 is a graph for explaining an operation of calculating a component amount and a component ratio according to an embodiment of the present inventive concept. Referring to FIG. 7, the horizontal axis may be defined as the type (e.g., color) of sub-pixel, and the vertical axis may be defined as the size of the image data value corresponding to the sub-pixels. For convenience of explanation, with reference to the reference numerals of FIG. 5, FIG. 7 will be described.

It is assumed that the first data corresponding to red has a larger value than the second data corresponding to green and the third data corresponding to blue. It is assumed that the second data has a larger value than the third data. Since yellow is a mixed color of red and green, the component amount Iy and the component ratio Py may be calculated based on the first and second data.

$$I_y = \min(R, G) \quad \text{Equation 4}$$

Referring to Equation 4, the image data processing device 100 may determine a smaller value from among the first data and the second data as the component amount Iy corresponding to yellow. In FIG. 7, the value of the second data may be determined as the component amount Iy. If yellow is a 1:1 mixed color of red and green, the values of the first and second data may be removed or reduced up to a size that the values of the first data and the second data overlap (e.g., overlap when viewed in the color direction of FIG. 7). The size that the values of the first and second data overlap is equal to the smaller one of the first data and the second data (e.g., the component amount). Thus, the component amount Iy may be the upper limit of the fourth data corresponding to yellow.

$$P_Y = \frac{\min(R, G)}{\max(R, G)} \quad \text{Equation 5}$$

Referring to Equation 5, the image data processing device 100 may determine a ratio of a small value to a large value from among the first data and the second data as a component ratio Py. In FIG. 7, the ratio of the second data to the first data may be determined as the component ratio Py. As the component ratio increases, an image of a color close to yellow may be displayed. As the component ratio Py decreases, an image of a color close to red or green may be displayed. The component ratio Py may be an index indicating the ratio at which the first and second data are dispersed or replaced with the fourth data.

Figure 8:
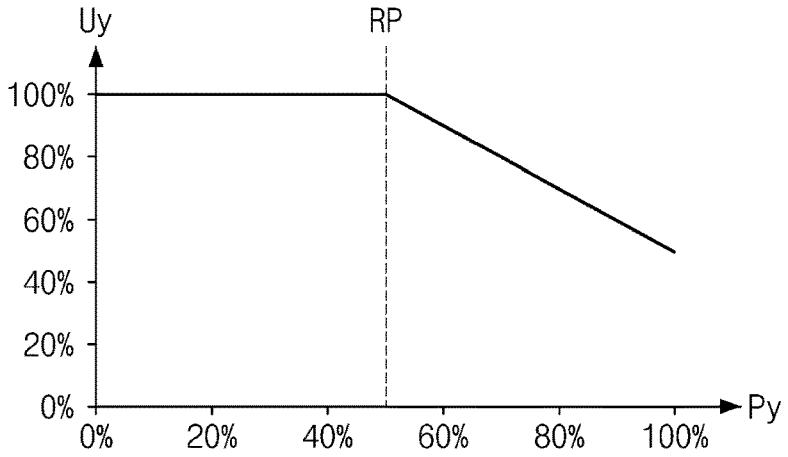
FIG. 8 is a graph for explaining an operation of calculating a utilization rate from a component ratio according to an embodiment of the present inventive concept.

FIG. 8 is a graph for explaining an operation of calculating a utilization rate from a component ratio according to an embodiment of the present inventive concept. Referring to FIG. 8, the horizontal axis may be defined by the size (e.g., value) of the component ratio Py, and the vertical axis is defined by the size (e.g., value) of the utilization rate Uy. FIG. 8 may be understood as an example of determining the utilization rate Uy using the transform function of the utilization rate Uy for the component ratio Py. For convenience of explanation, with reference to the reference numerals of FIG. 5, FIG. 8 will be described.

When the component ratio Py is equal to or less than the reference ratio RP, the image data processing device 100 may determine the utilization rate Uy to be 1 (100%). In this case, one of the first data or the second data may be completely removed or reduced. That is, any one of the first sub-pixel CP1 and the second sub-pixel CP2 may not emit light. If the first and second sub-pixels CP1 and CP2 are used more frequently than the fourth sub-pixel CP4 by image data RGB, by this operation, the degradation rates of the first and second sub-pixels CP1 and CP2 may be reduced, and the deterioration difference between the first sub-pixel CP1, the second sub-pixel CP2, and the fourth sub-pixel CP4 may be reduced.

The reference ratio RP may be a set or predetermined value of the component ratio Py, which defines a case where the difference between the first data and the second data is so large that the operation of reducing the difference in the initial luminance ratio Li of each of the sub-pixels may be meaningless or not achieve desired results. Illustratively, the component ratio Py corresponding to the reference ratio RP in FIG. 8 may be defined as 0.5 (50%). That is, when the component ratio Py is 50% or less, the utilization rate Uy may be 100%. The value of the fourth data may be the product of the utilization rate Uy and the component amount Iy. In this case, the value of the fourth data may be equal to the component amount Iy.

If the component ratio Py is greater than the reference ratio RP, in relation to the image data processing device 100, the utilization rate Uy may have a value decreased as the component ratio Py increases. In this case, in order for the luminance reduction amount Ld of each of the first sub-pixel CP1, the second sub-pixel CP2, and the fourth sub-pixel CP4 to be similar, the values of the first data and the second data are reduced and the value of the fourth data may have values similar to the modulated first and second data. Therefore, the deterioration difference between the first sub-pixel CP1, the second sub-pixel CP2, and the fourth sub-pixel CP4 may be reduced.

The transform function of FIG. 8 will be understood as an example, and the transform function may be set considering the degradation degree, degradation rate, and luminance reduction rate of each of the sub-pixels. For example, as the component ratio Py increases, the utilization rate Uy may be reduced linearly or nonlinearly. For example, the transform function may include a log function or an exponential function.

Figure 9:
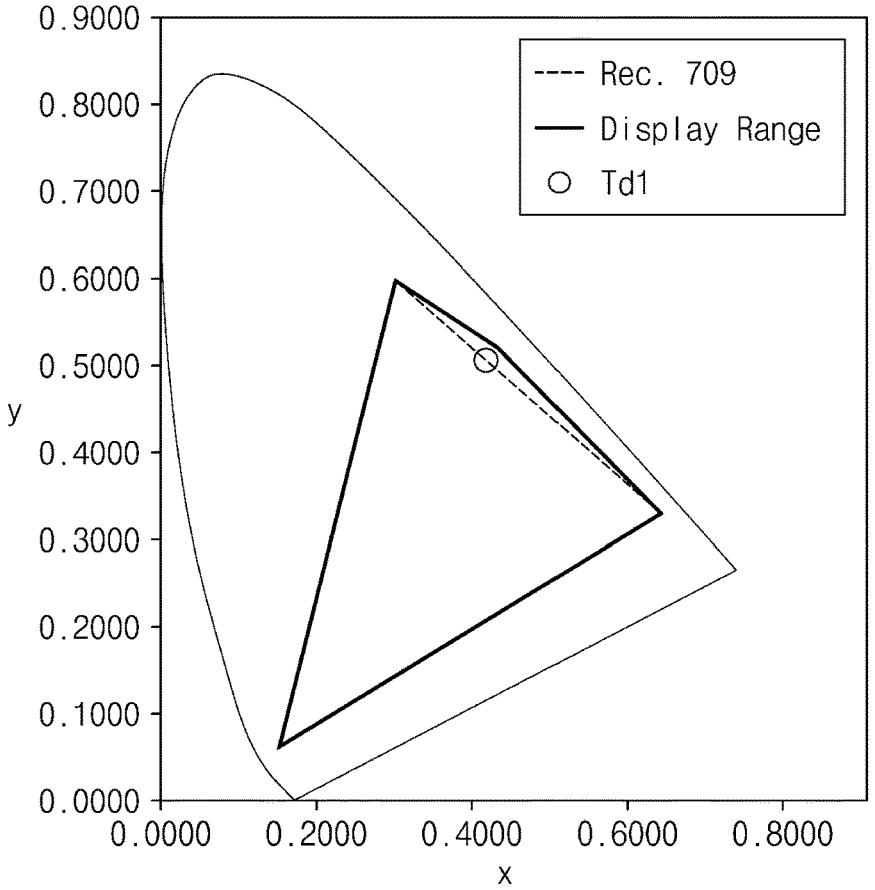
FIG. 9 is a graph for explaining an operation of calculating a light emission amount from a component amount and a utilization rate according to an embodiment of the present inventive concept.

FIG. 9 is a graph for explaining an operation of calculating a light emission amount from a component amount and a utilization rate according to an embodiment of the present inventive concept. FIG. 9 is a view showing a color recognized by a person as a CIE diagram based on a tristimulus value. A horseshoe-shaped area represents a CIE color space. An area indicated by the dotted line (e.g., uncovered dotted line and covered dotted line in FIG. 9) is a Rec. 709 color space. The tetragonal area (e.g., area of four-sided region) indicated by the solid line represents the display range of the image by the first to fourth sub-pixels CP1 to CP4.

The graph of FIG. 9 may be determined based on the XYZ color space. The three-dimensional coordinate values corresponding to the XYZ color space may be normalized to xyz values, and may satisfy x+y+z=1. The horizontal axis of FIG. 9 is defined by the size of the x value, and the vertical axis is defined by the size of the y value. In the Rec. 709 color space, the color corresponding to the vertex having the smallest x value and y value is blue, the color corresponding to the vertex having the largest y value is green, and the color corresponding to the vertex having the largest x value is red.

Since the unit pixel PX1 includes the fourth sub-pixel CP4 corresponding to yellow, an area not included in the Rec. 709 color space and corresponding to yellow may be included in the display range. The color corresponding to the vertex of the display range not included in the Rec. 709 color space may be yellow. Illustratively, the XYZ three-dimensional coordinate value corresponding to yellow may be (0.8296, 0.9977, 0.0920), which is a value increased by 5% in Rec. 709.

The area Td1 corresponding to image data RGB is displayed as a circle in FIG. 9. Illustratively, it is assumed that the first data of the image data RGB is 1, the second data is 1, and the third data is 0. In the Rec. 709 color space, the area Td1 may be formed on the dotted line connecting the vertex corresponding to green and the vertex corresponding to red. The modulation image data RGBA may be calculated from Equation 6 or 7 using the component amount Iy and the utilization rate Uy described with reference to FIGS. 7-8.

$$\begin{bmatrix} X_{in} \\ Y_{in} \\ Z_{in} \\ I_Y \times U_Y \end{bmatrix} = \begin{bmatrix} X_R & X_G & X_B & X_A \\ Y_R & Y_G & Y_B & Y_A \\ Z_R & Z_G & Z_B & Z_A \\ 0 & 0 & 0 & 1 \end{bmatrix} \begin{bmatrix} R \\ G \\ B \\ A \end{bmatrix} \quad \text{Equation 6}$$

$$\begin{bmatrix} R \\ G \\ B \\ A \end{bmatrix} = \begin{bmatrix} X_R & X_G & X_B & X_A \\ Y_R & Y_G & Y_B & Y_A \\ Z_R & Z_G & Z_B & Z_A \\ 0 & 0 & 0 & 1 \end{bmatrix}^{-1} \begin{bmatrix} X_{in} \\ Y_{in} \\ Z_{in} \\ I_Y \times U_Y \end{bmatrix} \quad \text{Equation 7}$$

Referring to Equations 6 and 7, $X_{in}$, $Y_{in}$, and $Z_{in}$ are defined as three-dimensional coordinate values obtained by converting image data RGB based on the XYZ color spaces. Together with the three-dimensional coordinate values, the value of the fourth data, which is defined by the product of the component amount Iy and the utilization rate Uy, may be expressed as a column vector. Each of R, G, B, and A may be defined as a value of first to fourth modulation data. The transform matrix includes components $X_R$, $X_G$, . . . , $Z_B$, $Z_A$ for the first to fourth modulation data to be transformed into three-dimensional coordinate values by the XYZ color space.

The transform matrix may be a 4×4 matrix. The fourth row of the transform matrix includes (0, 0, 0, 1) components. That is, the fourth modulation data A is the same as the fourth data. Since the transform matrix may be a 4×4 matrix and the column vector includes four components, one value for R, G, B, and A may be calculated. The first to fourth modulation data may be calculated by matrix multiplication operation of the inverse matrix of the transform matrix and a column vector.

Referring to the value (1,1,0) of the image data RGB and the graph of FIG. 8, the component amount Iy may be 1, the component ratio Py may be 1, and the utilization rate Ey may be 0.5. Under these conditions and the condition of the XYZ three-dimensional coordinate value corresponding to yellow, the first to fourth modulation data may be calculated as (0.45, 0.46, 0.03, 0.5). In this case, the luminance reduction amounts Ld corresponding to the first to fourth sub-pixels CP1 to CP4 may be calculated as (0.10, 0.11, 0.00, 0.12). That is, the image data RGB may be converted to allow the degradation amounts of the first sub-pixel CP1, the second sub-pixel CP2, and the fourth sub-pixel CP4 to be more uniform.

As described above, FIGS. 2-9 illustrate that the fourth sub-pixel CP4, the fourth data, and the fourth modulation data correspond to yellow, but the inventive concept is not limited thereto. For example, the fourth data may be cyan, and in this case, the component amount Iy, the component ratio Py, and the utilization rate Ey may be calculated using data corresponding to green and blue of the image data RGB. For example, the fourth data may be magenta, and in this case, the component amount Iy, the component ratio Py, and the utilization rate Ey may be calculated using data corresponding to red and blue of image data RGB.

Figure 10:
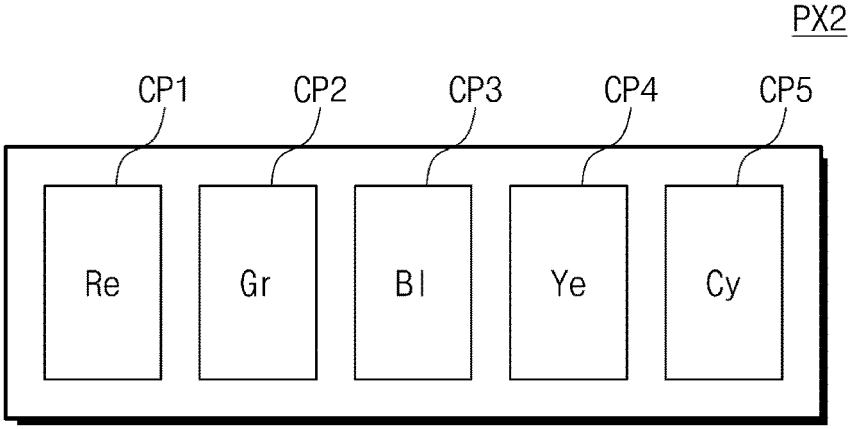
FIG. 10 is an exemplary view of a unit pixel according to an embodiment of the inventive concept.

FIG. 10 is an exemplary view of a unit pixel according to an embodiment of the inventive concept. Referring to FIG. 10, the unit pixel PX2 may include first to fifth sub-pixels CP1 to CP5. Illustratively, it is assumed that the first sub-pixel CP1 is a red color pixel, the second sub-pixel CP2 is a green color pixel, the third sub-pixel CP3 is a blue color pixel, the fourth sub-pixel CP4 is a yellow color pixel, and the fifth sub-pixel CP5 is a cyan color pixel. The arrangement of the first to fifth sub-pixels CP1 to CP5 is not limited to FIG. 10.

Figure 11:
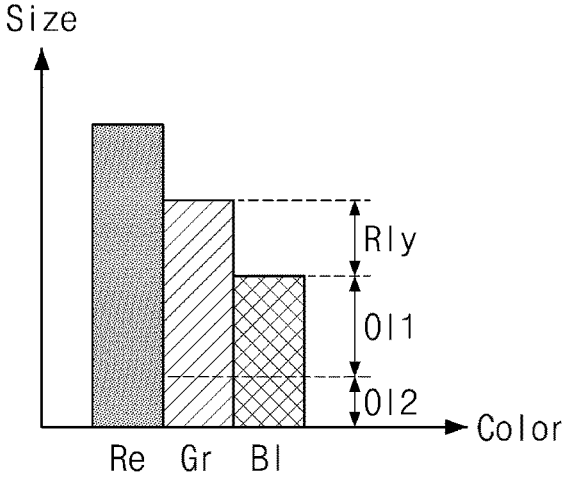
FIG. 11 is a graph for explaining an operation of calculating a component amount and a component ratio according to an embodiment of the present inventive concept.
Figure 12:
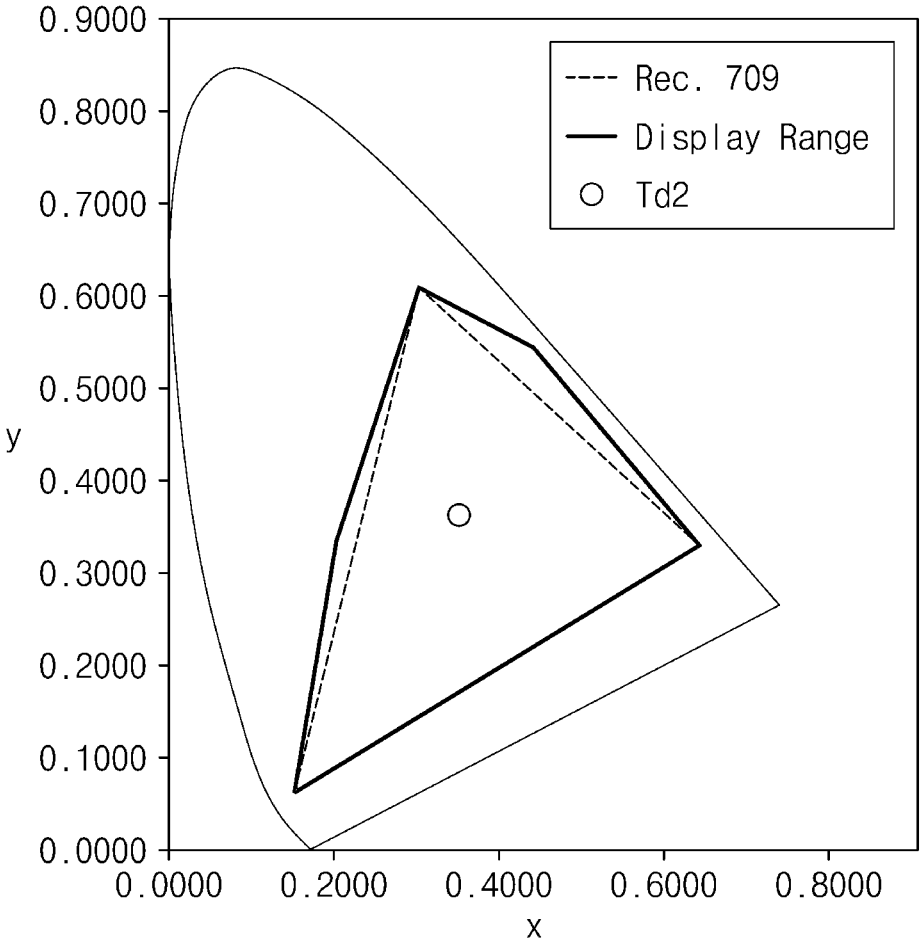
FIG. 12 is a graph for explaining an operation of calculating a light emission amount from a component amount and a utilization rate according to an embodiment of the present inventive concept.

Hereinafter, for convenience of description, the technical idea of the inventive concept described with reference to FIGS. 11-12 is described assuming that the unit pixel PX2 includes three color pixels representing the primary color and two color pixels representing the mixed color. And, for convenience of explanation, it is assumed that the two mixed colors are yellow and cyan. It will be understood that the mixed colors described below may be applied to various mixed colors including magenta.

FIG. 11 is a graph for explaining an operation of calculating a component amount and a component ratio. FIG. 11 is a graph for explaining an operation of converting image data RGB into modulation image data corresponding to five color pixels. Referring to FIG. 11, the horizontal axis is defined as the type (e.g., color) of the sub-pixels, and the vertical axis is defined as the size of the image data value corresponding to the sub-pixels. The image data processing device 100 of FIG. 5 may be a device for generating modulation image data corresponding to five color pixels. Accordingly, for convenience of description, with reference to the reference numerals of FIGS. 5 and 10, FIG. 11 will be described.

It is assumed that the first data corresponding to red is 1, the second data corresponding to green is 0.75, and the third data corresponding to blue is 0.5. Since yellow is a mixed color of red and green, a first component amount Iy corresponding to yellow may be calculated based on the first and second data. Since cyan is a mixed color of green and blue, a second component amount Ic corresponding to cyan may be calculated based on the second and third data. However, since green is commonly used for yellow and cyan, the second data corresponding to green may be distributed to the fourth data corresponding to yellow and the fifth data corresponding to cyan at a set or predetermined ratio.

$$I_Y = \min(R, G, B) \times \alpha + (\min(R, G) - \min(R, G, B)) = \min(R, G) - (1 - a) \times \min(R, G, B) \quad \text{Equation 8}$$

$$I_C = \min(R, G, B) \times (1 - \alpha) + (\min(G, B) - \min(R, G, B)) = \min(G, B) - a \times \min(R, G, B) \quad \text{Equation 9}$$

$$\alpha = \frac{R}{R + B} \quad \text{Equation 10}$$

Referring to Equation 8, the first component amount Iy may be the upper limit of the fourth data corresponding to yellow. The image data processing device 100 calculates the remaining component amount (min(R,G)−min(R,G,B)) obtained by subtracting the smallest value from among the first to third data from a small value (e.g., the lowest value) from among the first and second data. The image data processing device 100 may determine the first component amount Iy by adding the overlapped component amount (e.g., (min(R,G,B)*α)) to the remaining component amount. Through another method, the image data processing device 100 may determine the first component amount Iy by subtracting the overlapped component amount (e.g., (min (R,G,B)*(1−α))) from a small value (e.g., the lowest value) from among the first and second data.

Referring to Equation 9, the second component amount Ic may be the upper limit of the fifth data corresponding to cyan. The image data processing device 100 calculates the remaining component amount (min(G,B)−min(R,G,B)) obtained by subtracting the smallest value from among the first to third data from a small value from among the second and the third data. The image data processing device 100 may determine the second component amount Ic by subtracting the overlapped component amount (e.g., (min(R,G, B)*(1−α))) from the remaining component amount. Through another method, the image data processing device 100 may determine the second component amount Ic by subtracting the overlapped component amount (e.g., (min (R,G,B)*α)) from a small value (e.g., the lowest value) from among the second and third data.

Referring to Equation 10, a may be defined to compute the overlapped component amount. α is defined by a ratio of the first data to the sum of the first data and the third data. α may be a ratio for distributing the smallest value of the first to third data to the fourth data and the fifth data.

In FIG. 11, the remaining component amount RIy corresponding to yellow is 0.75−0.5, that is, 0.25. The overlapped component amount 0I1 (min(R,G,B)*α) is 0.5*0.67, that is 0.33. Thus, the first component amount Iy is 0.33+0.25, that is, 0.58.

Through another method, the first component amount Iy may be calculated as 0.58 by subtracting 0.17, which is the overlapped component amount 0I2 (min(R,G,B)*(1−α)) from 0.75, which is a small value from among the first and second data.

In FIG. 11, the remaining component amount corresponding to cyan is 0.5−0.5, that is, 0. Since the overlapped component amount 0I2 (min(R,G,B)*(1−α)) is 0.17, the second component amount Ic is 0.17. Through another method, the second component from amount Ic may be calculated as 0.17 by subtracting 0.33, which is the overlapped component amount 0I1 (min(R,G,B)*α) from 0.5, which is a small value among the second and third data.

The calculation of the component ratio follows the method of Equation 5.

The first component ratio corresponding to yellow is a ratio of a small value to a large value from among the first data and the second data, and is 0.75. The second component ratio corresponding to cyan is a ratio of a small value to a large value from among the second data and the third data, and is 0.67. Referring to the utilization rate transform function of FIG. 8, the first utilization rate corresponding to yellow is about 0.75, and the second utilization rate is about 0.83.

The value of the fourth data may be a product of the first component amount Iy and the first utilization rate, and is 0.58*0.75, that is, 0.44. The value of the fifth data may be a product of the second component amount Ic and the second utilization rate, and is 0.17*0.83, that is, 0.14. That is, when distributing data to five sub-pixels, by distributing commonly used colors according to the ratio α, the data may be modulated such that the degradation may be more uniformly distributed in the sub-pixels. As a result, an afterimage may be reduced or prevented.

FIG. 12 is a graph for explaining an operation of calculating a light emission amount from a component amount and a utilization rate according to an embodiment of the present inventive concept. FIG. 12 is a view showing a color recognized by a person as a CIE diagram based on a tristimulus value. A horseshoe-shaped area represents a CIE color space. An area indicated by the dotted line (e.g., uncovered dotted line and covered dotted line in FIG. 12) is a Rec. 709 color space. The pentagonal area (e.g., area of five-sided region) indicated by the solid line represents the display range of the image by the first to fifth sub-pixels CP1 to CP5.

Since the unit pixel PX1 may include the fourth sub-pixel CP4 corresponding to yellow and the fifth sub-pixel CP5 corresponding to cyan, an area not included in the Rec. 709 color space and corresponding to yellow and cyan may be included in the display range. The color corresponding to the vertex between the x and y values of green and the x and y values of red may be yellow. The color corresponding to the vertex between the x and y values of blue and the x and y values of green may be cyan. Illustratively, the XYZ three-dimensional coordinate value corresponding to yellow may be (0.8296, 0.9977, 0.0920), which is a value increased by 5% in Rec. 709. Illustratively, the XYZ three-dimensional coordinate value corresponding to cyan may be (0.4556, 0.7448, 1.0659), which is a value increased by 20% in Rec. 709.

The area Td2 corresponding to image data RGB is displayed as a circle. As shown in FIG. 11, it is assumed that the first data of the image data RGB may be 1, the second data may be 0.75, and the third data may be 0.5. The modulation image data may be calculated from Equation 11 using the first component amount Iy, the second component amount Ic, the first utilization rate Uy, and the second utilization rate Uc described with reference to FIG. 11.

$$\begin{bmatrix} R \\ G \\ B \\ A \\ C \end{bmatrix} = \begin{bmatrix} X_R & X_G & X_B & X_A & X_C \\ Y_R & Y_G & Y_B & Y_A & Y_C \\ Z_R & Z_G & Z_B & Z_A & Z_C \\ 0 & 0 & 0 & 1 & 0 \\ 0 & 0 & 0 & 0 & 1 \end{bmatrix}^{-1} \begin{bmatrix} X_{in} \\ Y_{in} \\ Z_{in} \\ I_Y \times U_Y \\ I_C \times U_C \end{bmatrix} \quad \text{Equation 11}$$

Referring to Equation 11, $X_{in}$, $Y_{in}$, and $Z_{in}$ are defined by three-dimensional coordinate values obtained by converting image data RGB based on the XYZ color spaces. Together with the three-dimensional coordinate values, a value of fourth data defined by the product of the first component amount Iy and the first utilization rate Uy and a value of the fifth data defined by the product of the second component amount Ic and the second utilization rate Uc are represented as a column vector. Each of R, G, B, A, and C may be defined as a value of first to fifth modulation data. The transform matrix includes components $X_R$, $X_G$, . . . , $Z_A$, $Z_C$ for the first to fifth modulation data to be transformed into three-dimensional coordinate values by the XYZ color space.

The transform matrix is a 5×5 matrix. The fourth row of the transform matrix may include (0, 0, 0, 1, 0) components, and the fifth row includes (0, 0, 0, 0, 1) components. That is, the fourth modulation data A is the same as the fourth data, and the fifth modulation data is the same as the fifth data. Since the transform matrix is a 5×5 matrix and the column vector includes five components, one value for R, G, B, A, and C may be calculated. The first to fifth modulation data may be calculated by matrix multiplication operation of the inverse matrix of the transform matrix and a column vector.

Referring to the value (1, 0.75, 0.5) of the image data RGB described above, the values of the fourth and fifth data calculated in FIG. 11, and the graph of FIG. 12, the first to fifth modulation data may be calculated as (0.59, 0.17, 0.40, 0.44, 0.14). In this case, the luminance reduction amounts Ld corresponding to the first to fifth sub-pixels CP1 to CP5 may be calculated as (0.18, 0.02, 0.08, 0.10, 0.01). That is, the light emission amount corresponding to the first sub-pixel CP1 is decreased and the difference between the first and second sub-pixels CP1 and CP4 is reduced to 0.08. That is, the image data RGB may be converted so that the difference in the degradation amount of each of the sub-pixels is reduced.

Figure 13:
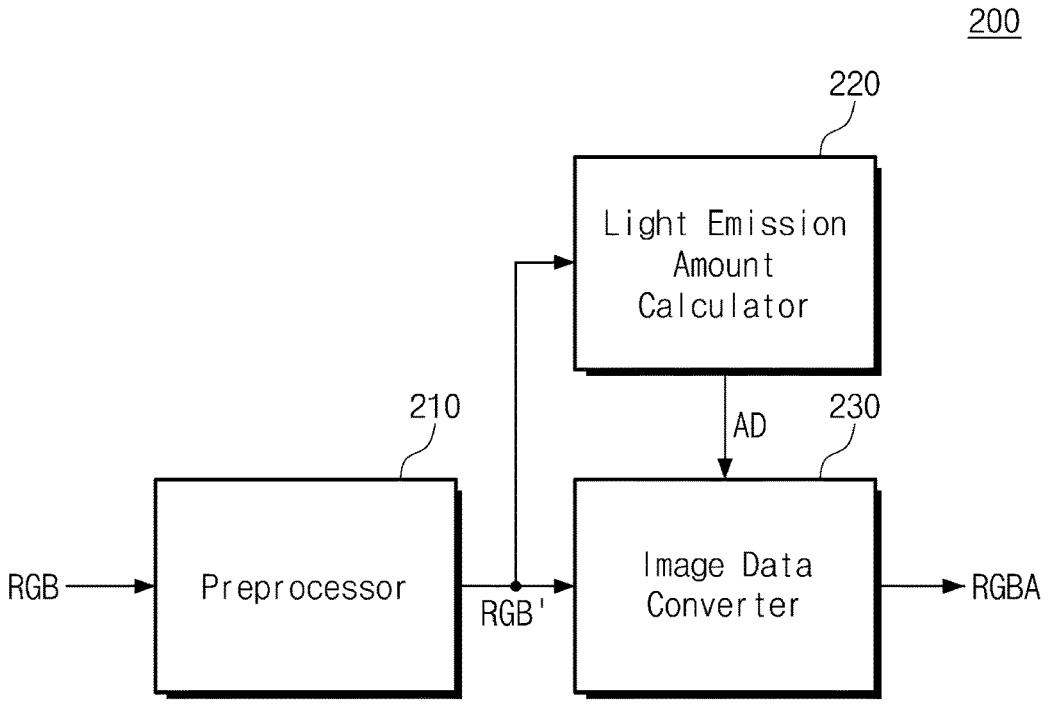
FIG. 13 is an exemplary block diagram of an image data processing device according to an embodiment of the inventive concept.

FIG. 13 is an exemplary block diagram of an image data processing device according to an embodiment of the inventive concept. Referring to FIG. 13, the image data processing device 200 may include a preprocessor 210, a light emission amount calculator 220 and an image data converter 230. The image data processing device 200 will be understood as an exemplary embodiment of the image data processing device 100 of FIG. 1. The preprocessor 210, the light emission amount calculator 220, and the image data converter 230 may be provided as an integrated circuit (IC), and may be implemented by a dedicated logic circuit such as a Field Programmable Gate Array (FPGA) or an Application Specific Integrated Circuit (ASIC).

The preprocessor 210 may preprocess image data RGB inputted from the outside. A pattern such as an icon or an information bar of a computer screen, or a logo of a TV broadcast may be continuously displayed in the same display area for a long period of time. In this case, deterioration may occur in the organic light emitting diodes included in the pixels of the corresponding display area and afterimage may occur. Illustratively, the preprocessor 210 may determine the corresponding display area based on the transition of the image data accumulated before the inputted image data RGB. The preprocessor 210 may preprocess the image data RGB to change the display area of the image data RGB corresponding to the display area. The preprocessed image data RGB' may be outputted to the light emission amount calculator 220 and the image data converter 230.

The light emission amount calculator 220 may calculate the data values corresponding to the fourth sub-pixel CP4 of FIG. 2 or the fourth and fifth sub-pixels CP4 and CP5 of FIG. 10 based on the preprocessed image data RGB'. The calculated data AD may be outputted to the image data converter 230. Since a method of calculating the data AD is substantially the same as that of the light emission amount calculator 110 described above, detailed description thereof is omitted.

The image data converter 230 may generate modulation image data RGBA based on the value of the data AD determined from the light emission amount calculator 220. The image data converter 230 may adjust values of data corresponding to red, green, and blue based on the value of the determined data AD. Since a method of generating the modulation image data RGBA is substantially the same as that of the image data converter 120 described above, detailed description thereof is omitted.

Figure 14:
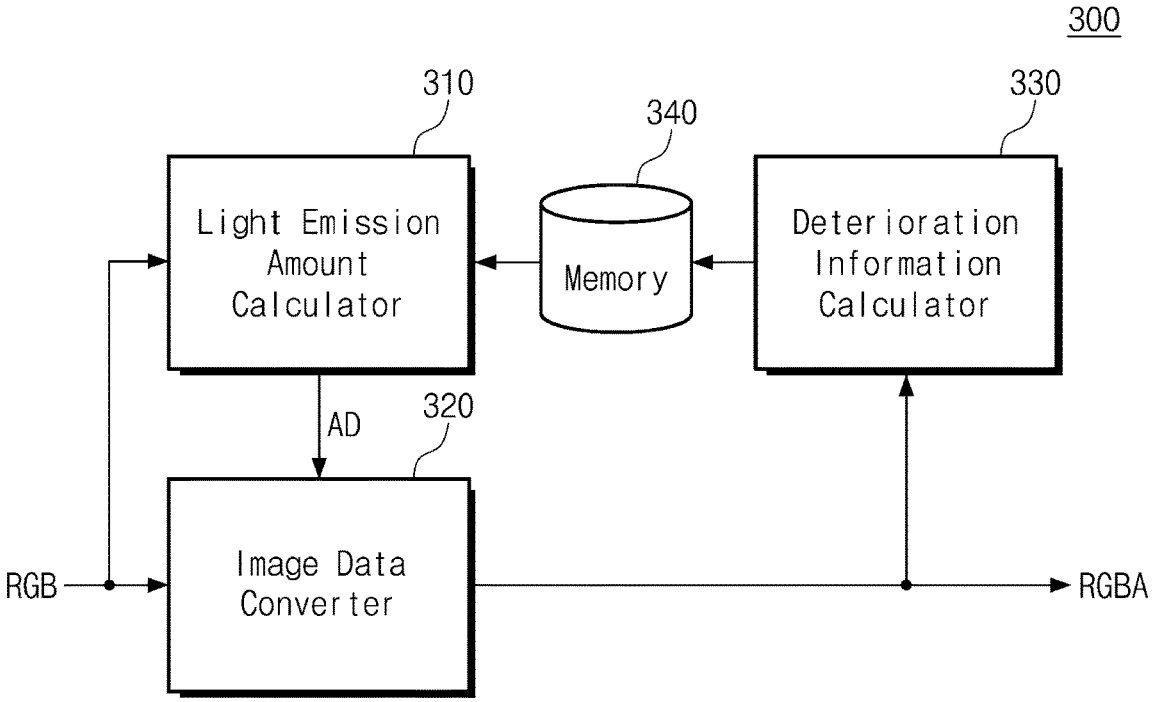
FIG. 14 is an exemplary block diagram of an image data processing device according to an embodiment of the inventive concept.

FIG. 14 is an exemplary block diagram of an image data processing device according to an embodiment of the inventive concept. Referring to FIG. 14, the image data processing device 300 may include a light emission amount calculator 310, an image data converter 320, a deterioration information calculator 330, and a memory 340. The image data processing device 300 will be understood as an exemplary embodiment of the image data processing device 100 of FIG. 1. The light emission amount calculator 310, the image data converter 320, the deterioration information calculator 330, and the memory 340 may be provided as an integrated circuit (IC), and may be implemented by a dedicated logic circuit such as a Field Programmable Gate Array (FPGA) or an Application Specific Integrated Circuit (ASIC).

The light emission amount calculator 310 may calculate the data values corresponding to the fourth sub-pixel CP4 of FIG. 2 or the fourth and fifth sub-pixels CP4 and CP5 of FIG. 10 based on the image data RGB. The calculated data AD may be outputted to the image data converter 230. Since a method of calculating the data AD is substantially the same as that of the light emission amount calculator 110 described above, detailed description thereof is omitted.

The image data converter 320 may generate modulation image data RGBA based on the value of the data AD determined from the light emission amount calculator 310. The image data converter 320 may adjust values of data corresponding to red, green, and blue based on the value of the determined data AD. Since a method of generating the modulation image data RGBA is substantially the same as that of the image data converter 120 described above, detailed description thereof is omitted.

The deterioration information calculator 330 may calculate the deterioration information of each of the sub-pixels based on the modulation image data RGBA. Deterioration information may depend on the value of the modulation data corresponding to the sub-pixel. For example, deterioration information may be generated by calculating the luminance reduction amount Ld of FIG. 3 from the value of the modulation data. The calculated deterioration information may be stored in the memory 340.

The memory 340 may store deterioration information. The memory 340 may accumulate and store the deterioration information generated based on the image data inputted before the image data RGB. That is, through the memory 340, the total amount of deterioration information according to the usage trend of the display device may be calculated. The accumulated deterioration information may be inputted to the light emission amount calculator 310.

The light emission amount calculator 310 may change the transform function as shown in FIG. 8 based on the accumulated deterioration information. The transform function of FIG. 8 is a function of the utilization rate for the component ratio, and the utilization rate may be an index representing the rate at which data is distributed or replaced with other sub-pixels. If it is determined that the deterioration degree of a specific sub-pixel is higher than that of an adjacent sub-pixel according to accumulated deterioration information, the light emission amount calculator 310 may adjust the transform function to lower the value of data corresponding to a specific sub-pixel. For example, if the deterioration degree of the sub-pixel corresponding to red is high, the light emission amount calculator 310 may adjust the transform function to increase the utilization rate corresponding to yellow.

According to the above description, image data corresponding to a specific color pixel may be dispersed to other color pixels while maintaining the displayed color. As a result, deterioration of pixels may be dispersed, display quality may be improved, and afterimage may be reduced.

Although the exemplary embodiments of the inventive concept have been described, it is understood that the inventive concept should not be limited to these exemplary embodiments but various changes and modifications may be made by one ordinary skilled in the art within the spirit and scope of the inventive concept as hereinafter claimed, and equivalents thereof.

What is claimed is:

1. An image data processing device comprising:

an image data converter configured to convert image data comprising a first data corresponding to a first color, a second data corresponding to a second color, and a third data corresponding to a third color into modulation image data comprising a first modulation data corresponding to the first color, a second modulation data corresponding to the second color, a third modulation data corresponding to the third color, and a fourth modulation data corresponding to a fourth color; and a light emission amount calculator configured to calculate the fourth modulation data based on a ratio between the first data and the second data, wherein the first to third colors are different from each other, and the fourth color comprises a color based on mixing the first color and the second color, and wherein the light emission amount calculator is configured to calculate a first component amount corresponding to an upper limit of the fourth modulation data by subtracting a first overlapped component amount from a lowest value from among the first data and the second data.

2. An image data processing device comprising:

an image data converter configured to convert image data comprising a first data corresponding to a first color, a second data corresponding to a second color, and a third data corresponding to a third color into modulation image data comprising a first modulation data corresponding to the first color, a second modulation data corresponding to the second color, a third modulation data corresponding to the third color, and a fourth modulation data corresponding to a fourth color; and a light emission amount calculator configured to calculate the fourth modulation data based on a ratio between the first data and the second data, wherein the first to third colors are different from each other, and the fourth color comprises a color based on mixing the first color and the second color, and wherein the light emission amount calculator is configured to determine a component amount corresponding to an upper limit of the fourth modulation data based on a lowest value from among the first data and the second data.

3. The image data processing device of claim 2, wherein when the ratio is less than a reference ratio, the light emission amount calculator is configured to determine the component amount as a value of the fourth modulation data.

4. The image data processing device of claim 2, wherein when the ratio is greater than a reference ratio, the light emission amount calculator is configured to determine a value smaller than the component amount as a value of the fourth modulation data, and wherein the value of the fourth modulation data decreases as the ratio increases.

5. The image data processing device of claim 2, wherein the light emission amount calculator is configured to calculate a utilization rate corresponding to the fourth color based on the ratio and to calculate the fourth modulation data based on the utilization rate.

6. The image data processing device of claim 5, wherein the light emission amount calculator is configured to determine the fourth modulation data by multiplying the component amount corresponding to the upper limit of the fourth modulation data by the utilization rate.

7. The image data processing device of claim 2, wherein the image data converter is configured to determine values of the first to third modulation data based on a value of the fourth modulation data calculated from the light emission amount calculator.

8. The image data processing device of claim 2, wherein the image data converter is configured to convert the image data into three-dimensional coordinate values based on an XYZ color space, and to apply the three-dimensional coordinate values and a value of the fourth modulation data to a transform matrix to generate the first to fourth modulation data.

9. The image data processing device of claim 8, wherein the first to fourth modulation data are generated by multiplying an inverse matrix of the transform matrix by a column vector including the three-dimensional coordinate values and the value of the fourth modulation data.

10. The image data processing device of claim 1, wherein the modulation image data further comprises fifth modulation data corresponding to a fifth color based on mixing the second color and the third color, wherein the light emission amount calculator is further configured to calculate the fifth modulation data based on a ratio between the second data and the third data.

11. The image data processing device of claim 10, wherein the light emission amount calculator is further configured to calculate a second component amount corresponding to an upper limit of the fifth modulation data by subtracting a second overlapped component amount from a lowest value from among the second data and the third data, wherein a ratio between the first overlapped component amount and the second overlapped component amount corresponds to a ratio between the third data and the first data.

12. The image data processing device of claim 11, wherein the first overlapped component amount has a value obtained by multiplying a ratio of the third data to a sum of the first data and the third data by a lowest value from among the first to third data, and the second overlapped component amount has a value obtained by multiplying a ratio of the first data to a sum of the first data and the third data by the lowest value from among the first to third data.

13. A display device comprising:

a display panel comprising a first pixel corresponding to a first color, a second pixel corresponding to a second color, a third pixel corresponding to a third color, and a fourth pixel corresponding to a fourth color based on mixing the first color and the second color; and a driving circuit configured to generate first to fourth data voltages provided to each of the first to fourth pixels based on image data comprising first data corresponding to the first color, second data corresponding to the second color, and third data corresponding to the third color, wherein the driving circuit comprises:

an image data processing device configured to generate first to fourth modulation data corresponding to the first to fourth pixels, respectively, based on a ratio between the first data and the second data, the image data processing device comprising a light emission amount calculator configured to calculate a utilization rate of the fourth pixel based on the ratio and to calculate a value of the fourth modulation data based on the utilization rate; and a data driver configured to generate the first to fourth data voltages based on the first to fourth modulation data.

14. The display device of claim 13, wherein the image data processing device further comprises an image data converter configured to generate the first to fourth modulation data by adjusting values of the first to third data based on the value of the fourth modulation data.

15. The display device of claim 14, wherein the image data processing device further comprises a preprocessor configured to adjust the image data to correspond to the first to fourth pixels based on image data accumulated before the image data.

16. The display device of claim 14, wherein the image data processing device further comprises a deterioration information calculator configured to calculate deterioration information of each of the first to fourth pixels based on the first to fourth modulation data, wherein a transform function of the utilization rate for the ratio is adjusted based on the deterioration information.

17. The display device of claim 13, wherein the first pixel is a red color pixel, the second pixel is a green color pixel, the third pixel is a blue color pixel, and the fourth pixel is a yellow color pixel.

18. The display device of claim 13, wherein the display panel further comprises a fifth pixel corresponding to a fifth color based on mixing the second color and the third color, wherein the image data processing device is further configured to generate fifth modulation data corresponding to the fifth pixel based on a ratio between the second data and the third data, wherein the data driver is further configured to generate a fifth data voltage based on the fifth modulation data.

19. The display device of claim 18, wherein when a value of the first data is greater than a value of the third data, a value of the fourth modulation data is greater than a value of the fifth modulation data, and when the value of the third data is greater than the value of the first data, the value of the fifth modulation data is greater than the value of the fourth modulation data.

20. The display device of claim 18, wherein the first pixel is a red color pixel, the second pixel is a green color pixel, the third pixel is a blue color pixel, the fourth pixel is a yellow color pixel, and the fifth pixel is a cyan color pixel.

* * * * *